US008381959B1

(12) United States Patent
Comerford

(10) Patent No.: US 8,381,959 B1
(45) Date of Patent: Feb. 26, 2013

(54) STAPLER EXTENSION MECHANISM

(75) Inventor: Edward M. Comerford, Sandown, NH (US)

(73) Assignee: Staplemate LLC, Hampstead, NH (US)

( * ) Notice: Subject to any disclaimer, the term of this patent is extended or adjusted under 35 U.S.C. 154(b) by 126 days.

(21) Appl. No.: 12/618,808

(22) Filed: Nov. 16, 2009

Related U.S. Application Data

(60) Provisional application No. 61/219,815, filed on Jun. 24, 2009.

(51) Int. Cl.
*B25C 1/02* (2006.01)

(52) U.S. Cl. ..... 227/110; 227/111

(58) Field of Classification Search ..... 227/110, 227/5, 129, 12, 147, 111, 156, 16, 132, 107
See application file for complete search history.

(56) References Cited

U.S. PATENT DOCUMENTS 3,336,617 A * 8/1967 Bosko et al. ..... 15/146
3,784,078 A * 1/1974 Escoe ..... 227/13
4,901,606 A * 2/1990 Christensen ..... 81/57.11
5,509,489 A * 4/1996 Lower, Jr. ..... 173/170
5,692,417 A * 12/1997 Irpino ..... 81/53.12
6,330,840 B1 * 12/2001 McCormick et al. ..... 81/57.3
6,547,165 B2 * 4/2003 Goodwin et al. ..... 239/532
2005/0156009 A1 * 7/2005 Gazlay ..... 227/130
2007/0204955 A1 * 9/2007 Manners ..... 156/344
2008/0017690 A1 * 1/2008 Galitsky ..... 227/154

* cited by examiner

*Primary Examiner* — M. Alexandra Elve
*Assistant Examiner* — Nathaniel Chukwurah
(74) *Attorney, Agent, or Firm* — Joseph E. Funk

(57) ABSTRACT

A stapler extension mechanism is disclosed that is attached to the operating handle of a squeeze handle stapler that permits the stapler to be operated against a ceiling without the operator having to climb onto a ladder, against a floor without the operator having to bend over, or into a wall. The stapler extension mechanism has a head that is fastened to the operating handle of the squeeze handle stapler and an adjustable elongated handle is attached to the head. The operator positions the stapler using the elongated handle, and then applies a pushing force via the elongated handle to depress the squeeze handle and operate the stapler.

11 Claims, 5 Drawing Sheets

STAPLER EXTENSION MECHANISM

RELATED APPLICATION

This utility patent application claims benefit under U.S. Provisional Patent Application No. 61/219,815, entitled "Stapler Extension Handle", filed on Jun. 24, 2009.

FIELD OF THE INVENTION

This invention relates to hand operated squeeze staplers and more particularly to a stapler extension mechanism that permits a hand operated squeeze stapler to be used remotely against ceilings, floors or walls without the need for ladders or scaffolding.

BACKGROUND OF THE INVENTION

In the prior art hand operated squeeze staplers are still widely used to staple materials against floors, walls and ceilings during construction and remodeling work.

When such a hand operated squeeze stapler is used to staple materials, such as acoustic ceiling tiles, to a ceiling the stapler operator must climb on a ladder, a scaffold or climb or some other means in order to reach the ceiling and utilize the stapler.

When such a hand operated squeeze stapler is used to staple materials, such as felt paper to a sub-floor to be underneath flooring, the stapler operator must bend over a lot in order to utilize the stapler. This is very uncomfortable and too often leads to damage to the stapler operator's back.

When such a hand operated squeeze stapler is used to staple materials against a wall, such as behind a chimney where there is a small space between the chimney and the wall the stapler operator either cannot reach into the small space at all or cannot easily reach into the small space.

Thus, there is a need for a means that can be attached to a conventional hand operated squeeze stapler that will permit the stapler operator to staple materials to hard to reach locations such as a ceiling without having to climb on anything in order to reach the ceiling, will permit the stapler operator to staple materials to a floor without having to bend over, and will permit the stapler operator to apply staples in a small space where it is impossible or difficult to reach by hand.

SUMMARY OF THE INVENTION

The foregoing need in the prior art for a means that can be attached to a conventional hand operated squeeze stapler that will permit the stapler operator to utilize the stapler to staple materials in hard to reach locations is met by the present invention. A stapler extension mechanism is disclosed herein which quickly and easily attaches to the squeeze operating lever of a hand operated squeeze stapler and permits the stapler to be used to apply staples in hard to reach locations.

The novel stapler extension mechanism has a head with an opening into which the operating handle of a conventional hand operated squeeze stapler is first inserted and the stapler handle is then temporarily locked in the head by a fastening means. The stapler extension mechanism head has an extension handle that is attachable to the head and the extension handle is used to position a stapler remotely from a person holding the extension handle. The extension handle may be segmented or telescoping to be adjustable in length. This is particularly handy for stapling to different height ceilings, and stapling to a floor from a standing position where the length of the extension handle is minimal.

In use on a ceiling an operator positions the stapler mounted on the end of the stapler extension mechanism against a position on the ceiling where a staple is to be applied and then pushes upward on the extension handle. The force is transmitted via the extension handle to the operating lever of the stapler to thereby depress the operating lever and actuate the stapler to insert a staple into the ceiling. The operator does not need to climb on a ladder or anything else to reach the ceiling.

In use on a floor an operator positions the stapler mounted on the end of the stapler extension mechanism on a position on the floor where a staple is to be applied and then pushes downward on the extension handle. The force is transmitted via the extension handle to the operating lever of the hand operated stapler to thereby depress the operating lever and actuate the stapler to insert a staple into the floor. The operator does not need to bend over to utilize the stapler on the floor.

In use against a wall an operator positions the stapler mounted on the end of the stapler extension mechanism against a position on the wall where a staple is to be applied and then pushes horizontally on the extension handle. The force is transmitted via the extension handle to the operating lever of the hand operated stapler to thereby depress the operating lever and actuate the stapler to insert a staple into the wall.

DESCRIPTION OF THE DRAWINGS

The invention will be better understood upon reading the following Detailed Description in conjunction with the drawings in which.

DETAILED DESCRIPTION

Figure 1:
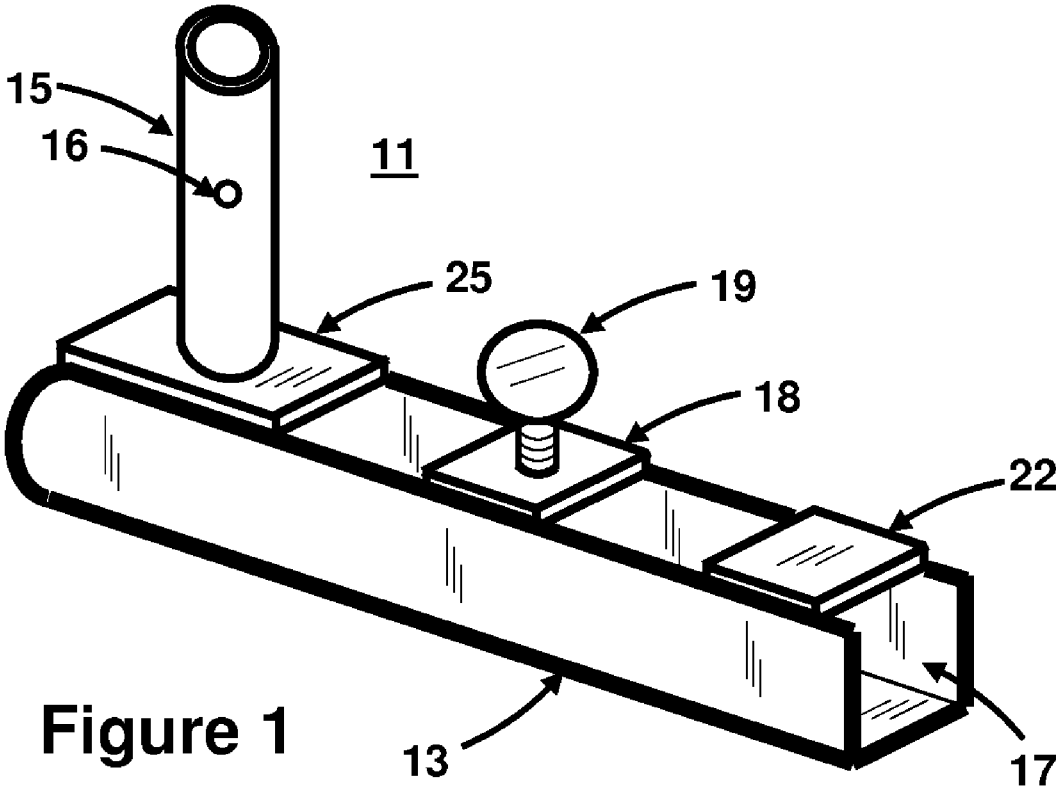
FIG. 1 is a perspective view of a first embodiment of the head of the stapler extension mechanism.

FIG. 1 is a perspective view of a first embodiment of the head portion 11 of the novel stapler extension mechanism 10. Head 11 comprises an elongated piece 13 of U-channel steel or other strong material that may have a thickness in the order of one-sixteenth of an inch, but may be thinner or thicker depending on the material used. Piece 13 has a U-channel 17 that is only slightly wider than the squeeze handle 21 of a hand stapler 20 (See stapler in FIG. 5). Across the open side of the U-channel are welded three flat pieces of steel or other strong material 22, 18 and 25 as shown. Piece 22 may have a thickness in the order of one-sixteenth of an inch, and pieces 18 and 25 may have a thickness in the order of one-eighth of an inch. Piece 18 has a threaded hole there through so needs to be thicker to accommodate a sufficient number of screw threads for use with screw 19. Piece 25 has a mounting piece 15 attached thereto for attaching an extension handle 12 to head 11 (FIG. 7) so needs extra strength to withstand the stresses of use. Piece 12 has the least stress applied thereto and may be thinner than pieces 18 and 25.

A hollow pipe segment 15 about two to three inches long is welded or otherwise fastened to flat piece 25 in a generally perpendicular orientation. An extension handle 12 is inserted inside hollow pipe 15, as shown in and described with reference to FIG. 7, when stapler extension 10 is to be utilized. The outside diameter of extension handle 12 is only slightly less than the inside diameter of hollow pipe segment 15 so that the two fit snugly together. Pipe segment 15 is equipped with a push button means 16 for retaining extension handle 12 inside of segment 15. Such retention means are known in the art for tent poles and other segmented pipe applications. Alternatively a hole can be provided through hollow pipe segment 15 and extension handle 12 through which a cotter pin or type of retention pin may be inserted.

Figure 6:
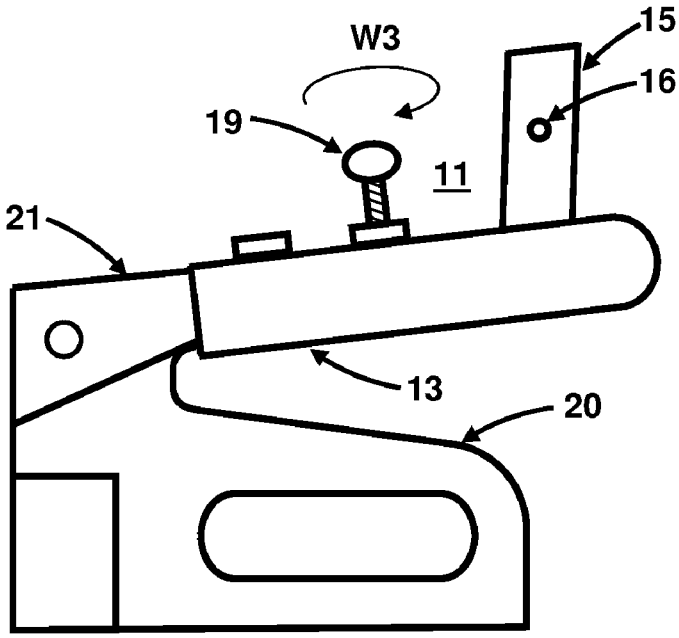
FIG. 6 shows a side view of the head of the stapler extension mechanism fully mounted on the operating lever of the hand operated stapler in preparation for attaching an extension handle to the stapler extension mechanism.
Figure 7:
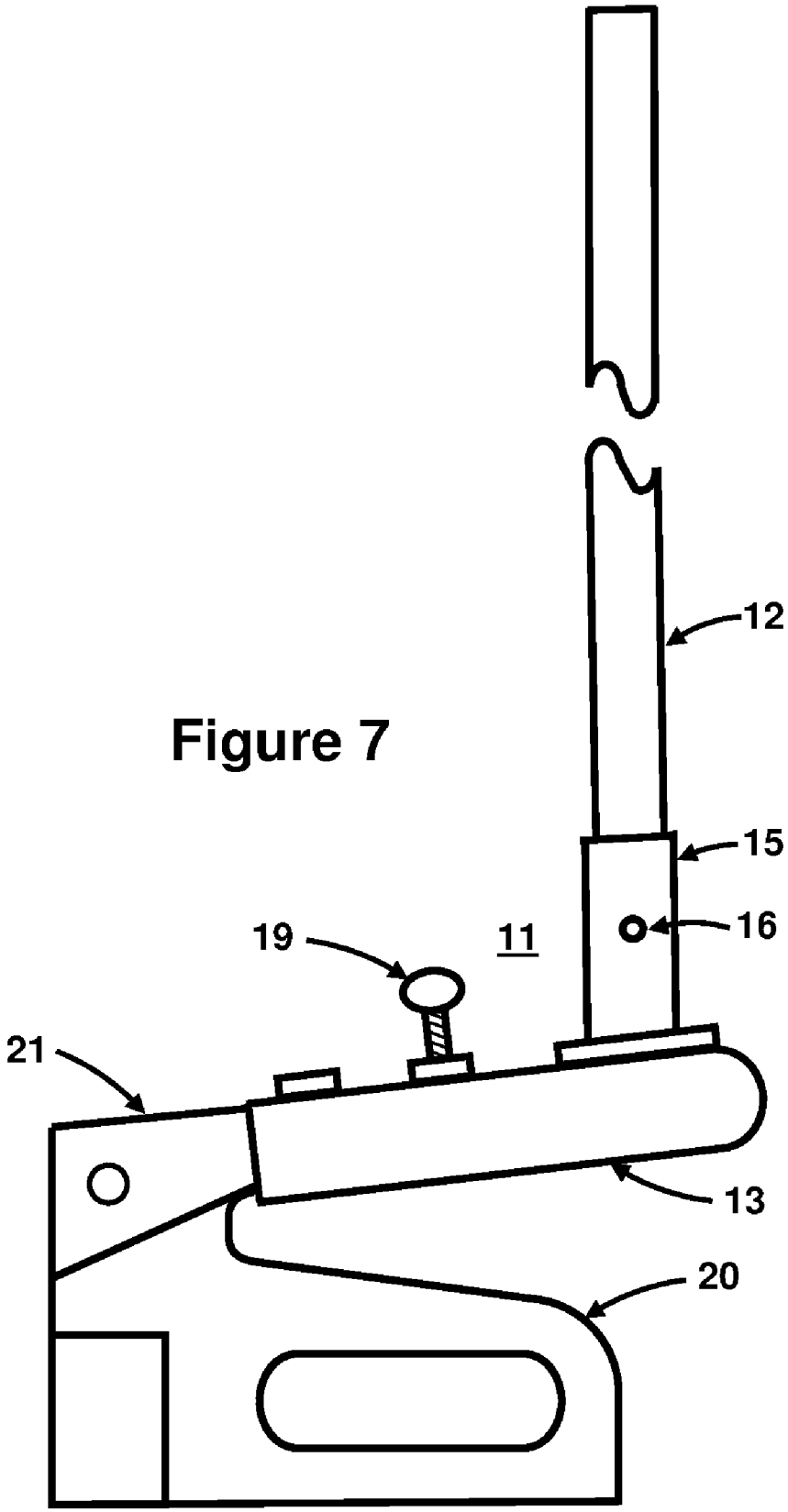
FIG. 7 shows an extension handle attached to the head of the stapler extension mechanism in preparation for using the extension handle with the stapler.
Figure 8:
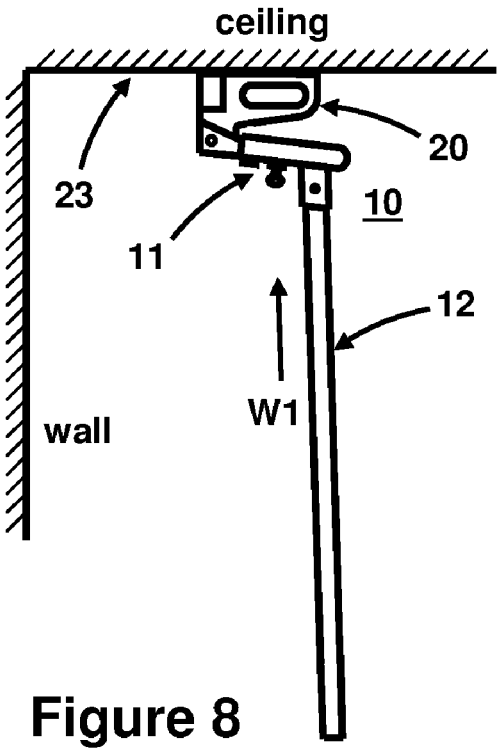
FIG. 8 shows a hand operated stapler with stapler extension mechanism attached being used to staple into a ceiling.

Flat piece 18 has a hole through its center that is tapped for a screw. A hand operated screw 19 is screwed into the tapped hole and is screwed into U-channel 17 to pinch and retain the squeeze handle 21 of a manually operated stapler 20 therein as shown in FIGS. 6 and 7.

Figure 2:
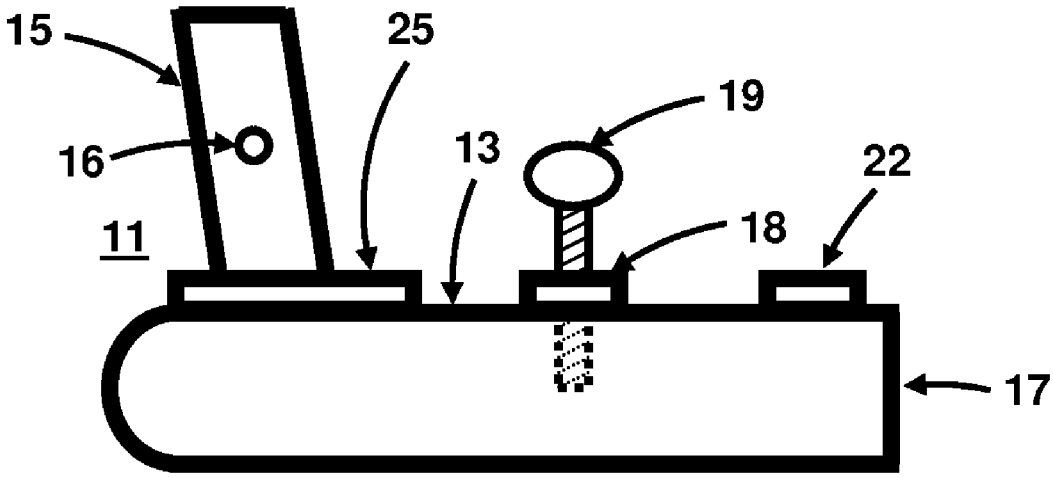
FIG. 2 is a side view of the head of the stapler extension mechanism.

FIG. 2 is a side view of the head 11 of the stapler extension mechanism 10. In this view hollow pipe segment 15 is deliberately shown slightly off vertical. In addition, how screw 19 passes into the interior of U-channel 17 to bind the handle 21 of a stapler 20 therein is shown.

Figure 3:
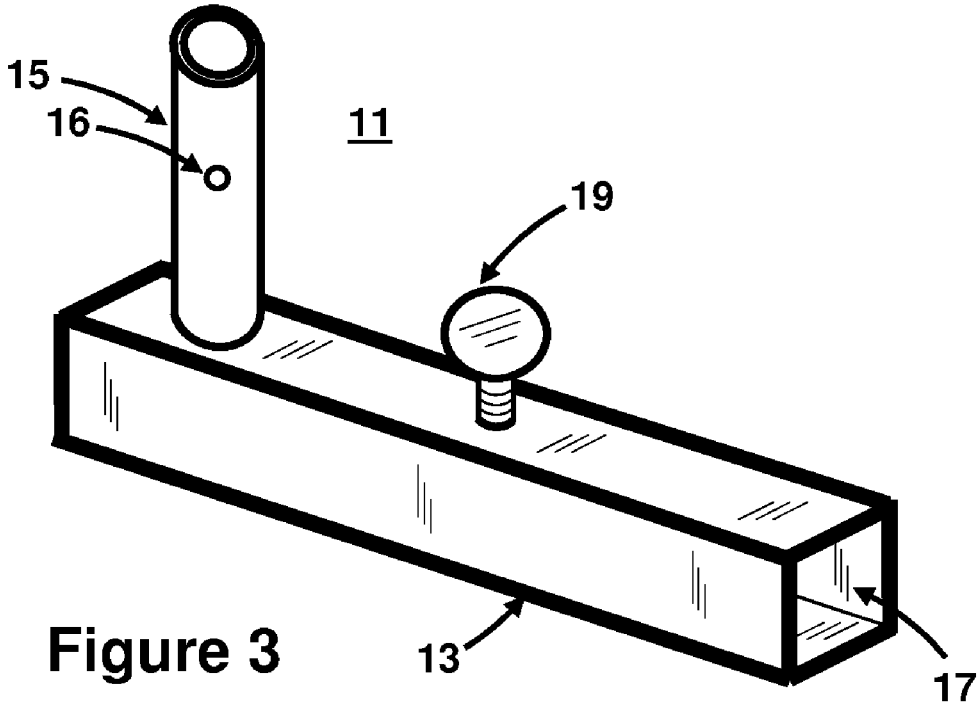
FIG. 3 is a perspective view of an alternative embodiment of the head of the stapler extension mechanism.

FIG. 3 is a perspective view of an alternative embodiment of the head 11 of the stapler extension mechanism. In this embodiment elongated piece 13 is a piece of square cross section pipe having no U-channel. Hollow pipe segment 15 is welded or otherwise fastened to metal piece 25 at one end of elongated piece 13. In addition, a hole is drilled through the top wall of elongated piece 13 and is tapped to receive hand operated 19 screw.

Figure 4:
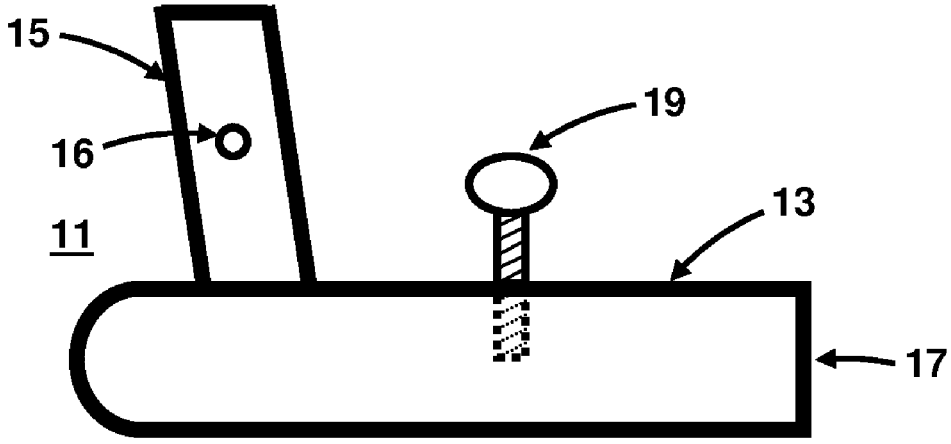
FIG. 4 is a side view of the alternative embodiment of the head of the stapler extension mechanism.

FIG. 4 is a side view of the alternative embodiment of the head 11 of the stapler extension 10. Again the hollow pipe segment 15 is deliberately shown slightly off vertical.

Figure 5:
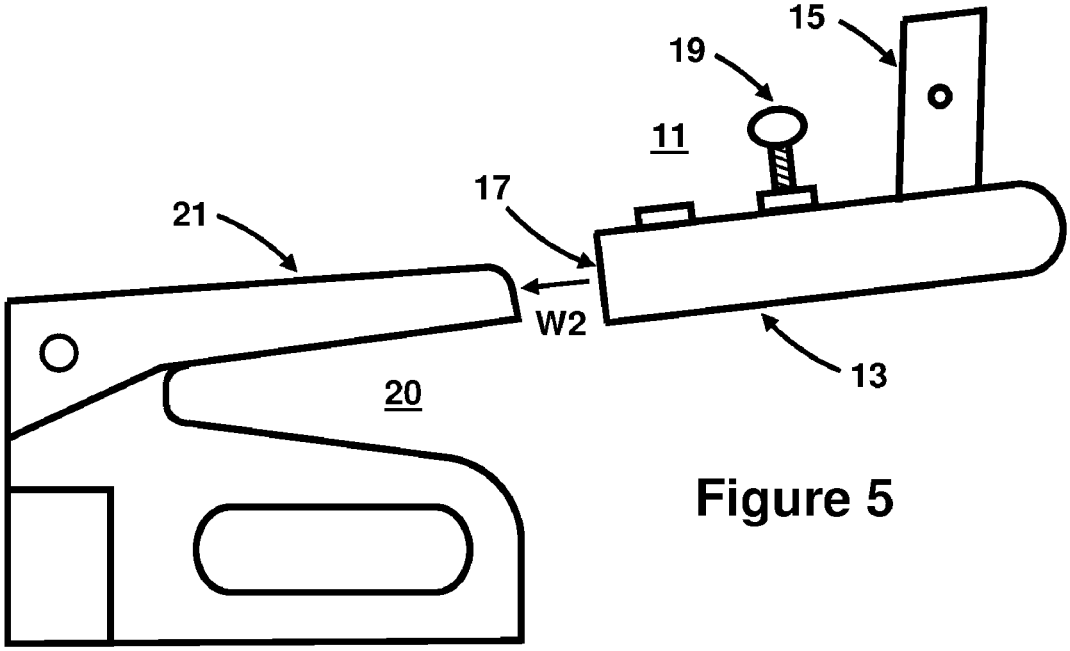
FIG. 5 is a side view of the head of the stapler extension mechanism being placed on the operating lever of the hand operated stapler in preparation for subsequently attaching an extension handle to the stapler extension mechanism.

FIG. 5 is a side view of the head 11 of the stapler extension mechanism 10 in the process of being placed on the operating lever 21 of the hand operated stapler 20 in preparation for inserting extension handle 12 into pipe segment 15 and using stapler extension mechanism 10 with stapler 20. The open end 17 of elongated piece 13 is moved in the direction of arrow W2 over stapler operating lever 21 which fits snugly inside piece 13.

FIG. 6 shows a side view of the head 11 of the stapler extension mechanism 10 fully mounted on operating lever 21 of hand operated stapler 20 in preparation for using stapler extension mechanism 10 with stapler 20. When head 11 is fully inserted onto operating lever 21 screw 19 is turned clockwise as represented by arrow W3 so that the tip of screw 13 impacts the top side of stapler operating lever 21 and thereby retains lever 21 inside the hollow channel of elongated piece 13.

FIG. 7 shows an extension handle 12 attached to head 13 of stapler extension mechanism 10 after head 13 has been fastened to stapler squeeze handle 21 in preparation for using stapler extension mechanism 10 with stapler 20. Extension handle 12 may comprise a single piece, two or more connecting pieces, or a telescoping piece the overall length of which is adjusted depending on the application of stapler extension mechanism 10.

Figure shows a hand operated stapler 20 with a stapler extension mechanism 10 attached thereto being used to staple into a ceiling 23. Depending on how high ceiling 23 is the length of extension handle 12 is adjusted for use of stapler 20. As may be seen a person using stapler 20 with a stapler extension mechanism 10 attached need not use a ladder or scaffolding. Stapler 20 is placed against ceiling 23 and a force if applied to pipe handle 12 in the direction of arrow W1 to push on squeeze handle 21 to thereby actuate stapler 20. The force is then removed, stapler 20 is repositioned and force is again placed on pipe handle 12 in the direction of arrow W1 to actuate stapler 20.

Figure 9:
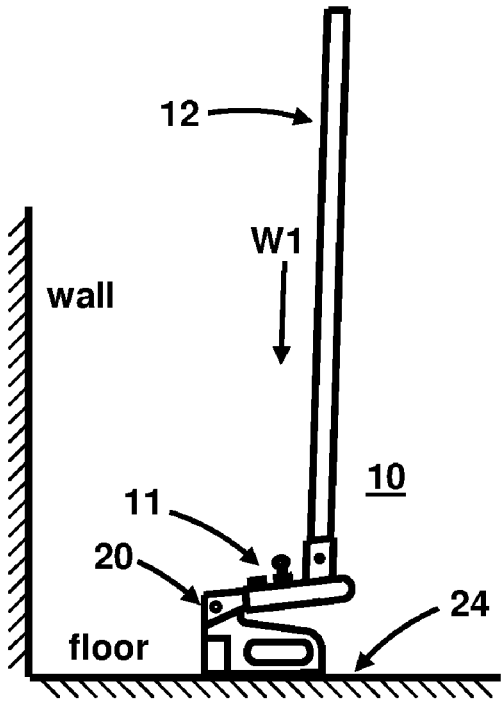
FIG. 9 shows a hand operated stapler with stapler extension mechanism attached being used to staple into a floor.

FIG. 9 shows a hand operated stapler with stapler extension mechanism 10 attached thereto being used to staple into a floor 24. Extension handle 12 need only be a few feet long. A person using stapler 20 with a stapler extension mechanism 10 attached need not bend over, but only to apply a force on extension handle 12 in the direction of arrow W1 to push on squeeze handle 21 to thereby actuate stapler 20.

Figure 10:
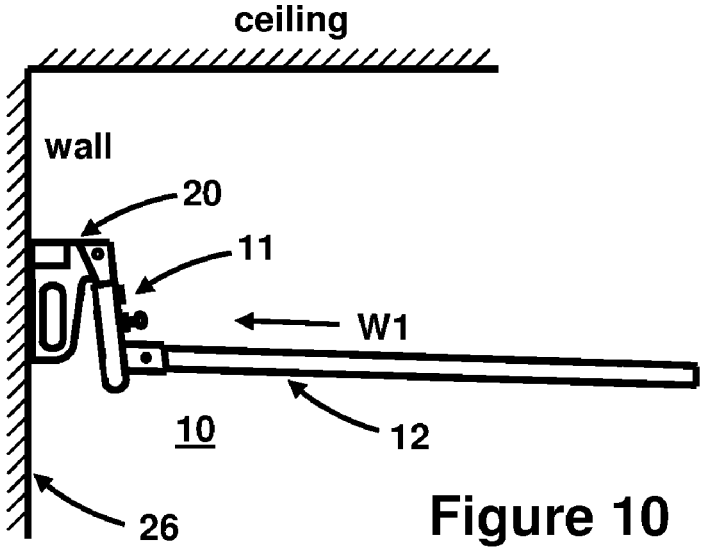
FIG. 10 shows a hand operated stapler with stapler extension mechanism attached being used to staple into a wall.

FIG. 10 shows a hand operated squeeze stapler 20 with stapler extension mechanism 10 attached thereto being used to staple against a wall 26. The length of extension handle 12 is selected as required for the application, and the operation is as described in the previous paragraphs.

While what has been described herein is a preferred embodiment of the invention and one alternative embodiment, those skilled in the art will understand that numerous changes may be made without departing from the spirit and scope of the invention.

The invention claimed is:

1. An extension mechanism for a manually operated squeeze handle stapler, that is not altered in any way, to be used to insert staples into surfaces, the extension mechanism comprising:

a head element;

a first channel in the head element into which the squeeze handle of the unaltered stapler is inserted for attaching the head element to the squeeze handle of a stapler;

an elongated handle; and a second channel in the head element into which the elongated handle is inserted for attaching the elongated handle to the head element;

wherein the head element may be positioned against a remote surface into which a staple is to be inserted, and a force is applied to the elongated handle in the direction of the stapler in order to actuate the squeeze handle of the stapler and thereby insert a staple into the remote surface.

2. An extension mechanism for a manually operated squeeze handle stapler in accordance with claim 1 further comprising first fastening means attached to the head element, the first fastening means being used to fasten the squeeze handle of the stapler to the head element after the squeeze handle of the stapler is inserted into the first channel of the head element.

3. An extension mechanism for a manually operated squeeze handle stapler in accordance with claim 2 further comprising a second fastening means for fastening the one end of the elongated handle to the head element after the one end of the elongated handle is inserted into the second channel in the head element.

4. An extension mechanism for a manually operated squeeze handle stapler in accordance with claim 3 wherein the elongated handle can be adjusted to different lengths.

5. An extension mechanism for a manually operated squeeze handle stapler in accordance with claim 2 wherein the elongated handle can be adjusted to different lengths.

6. An extension mechanism for a manually operated squeeze handle stapler in accordance with claim 1 wherein the second channel is for attaching the elongated handle to the head element comprises a second channel in the head element into which one end of the elongated handle is inserted.

7. An extension mechanism for a manually operated squeeze handle stapler in accordance with claim 6 further comprising a second fastening means for fastening the one end of the elongated handle to the head element after the one end of the elongated handle is inserted into the second channel in the head.

8. An extension mechanism for a manually operated squeeze handle stapler in accordance with claim 7 wherein the elongated handle can be adjusted to different lengths.

9. An extension mechanism for a manually operated squeeze handle stapler in accordance with claim 1 wherein the elongated handle can be adjusted to different lengths.

10. An extension mechanism for a manually operated squeeze handle stapler in accordance with claim 1 further comprising fastening means for fastening the one end of the elongated handle to the head element after the one end of the elongated handle is inserted into the second channel in the head element.

11. An extension mechanism for a manually operated squeeze handle stapler in accordance with claim 10 wherein the elongated handle can be adjusted to different lengths.

* * * * *